US005738171A

United States Patent [19]

Szarka

[11] Patent Number: 5,738,171

[45] Date of Patent: Apr. 14, 1998

[54] WELL CEMENTING INFLATION PACKER TOOLS AND METHODS

[75] Inventor: David D. Szarka, Duncan, Okla.

[73] Assignee: Halliburton Company, Duncan, Okla.

[21] Appl. No.: 775,534

[22] Filed: Jan. 9, 1997

[51] Int. Cl.[6] ..... E21B 33/13

[52] U.S. Cl. ..... 166/289; 166/291; 166/187; 166/194; 166/154; 166/184

[58] Field of Search ..... 166/154, 184, 166/187, 188, 192, 194, 285, 289, 291, 387

[56] References Cited

U.S. PATENT DOCUMENTS

| | | | |
|---|---|---|---|
| 3,768,562 | 10/1973 | Baker | 166/289 |
| 3,948,322 | 4/1976 | Baker | 166/289 |
| 4,869,324 | 9/1989 | Holder | 166/187 X |
| 5,038,862 | 8/1991 | Giroux et al. | 166/289 |
| 5,109,925 | 5/1992 | Stepp et al. | 166/187 X |
| 5,137,087 | 8/1992 | Szarka et al. | 166/289 |
| 5,277,253 | 1/1994 | Giroux et al. | 166/187 |
| 5,279,370 | 1/1994 | Brandell et al. | 166/386 |
| 5,314,015 | 5/1994 | Streich et al. | 166/184 |
| 5,348,089 | 9/1994 | Brandell et al. | 166/154 |
| 5,400,855 | 3/1995 | Stepp et al. | 166/187 X |

*Primary Examiner*—Roger J. Schoeppel
*Attorney, Agent, or Firm*—Craig W. Roddy; C. Clark Dougherty, Jr.

[57] ABSTRACT

The present invention provides an improved cementing inflation packer tool and methods of using the tool. The tool includes of a tubular housing having a packer inflating port disposed therein and a packer inflating port opening sleeve slidably disposed within the housing. The opening sleeve is movable between a closed position and an open position by a first cementing plug. An external packer sleeve having a pressurized fluid inflatable packer element attached thereto and a cementing port therein is sealingly disposed over the outer surface of the housing and the packer inflating port. The external packer sleeve provides a passageway from the packer inflating port to the inflatable packer element and check valve means are disposed in the passageway. A fluid rupturable member having a predetermined rupture pressure is sealingly attached over the cementing port.

20 Claims, 4 Drawing Sheets

WELL CEMENTING INFLATION PACKER TOOLS AND METHODS

BACKGROUND OF THE INVENTION

1. Field of the Invention

The present invention relates generally to cementing tools utilized in primary well cementing operations, and more particularly, to improved well cementing inflation packer tools and methods.

2. Description of the Prior Art

In cementing a string of pipe in a well, known in the art as primary cementing, a cement slurry is pumped downwardly through the pipe string to be cemented and then upwardly into the annulus between the pipe and the walls of the well bore. Upon setting, the cement bonds the pipe string to the walls of the well bore and restricts fluid movement between formations penetrated by the well bore. The string of pipe cemented in the well bore can be casing which extends from the surface to a subterranean formation or location, or it can be a pipe string known in the art as a liner. Liners do not extend to the surface and are generally connected to the casing string. Liners are often utilized in deviated wells, multi-lateral wells and deep wells.

In deviated wells (including horizontal wells) and multi-lateral wells, it is often the practice to place a slotted liner across a productive open hole section of the well bore. In order to cement the fluid tight portion of the liner in the well bore, a formation packer is required to prevent the cement slurry from filling or entering the productive open hole section into which the slotted portion of the liner extends. Heretofore, one or more stage cementing tools including an integral inflatable packer have been utilized to perform the liner cementing operation. Such stage cementing tools are mechanically complicated and expensive. Further, the cementing tools used are often cemented in the well bore along with the liner, and therefore, their use has involved high costs to the well owner. Also, when liner cementing tools are left in the well bore, it is advantageous to inflate the packer with cement. Most heretofore utilized tools including inflation packers have small valves and small interconnecting passageways through which the cement slurry must flow to inflate the packer. As a result, the tools have been subject to plugging, leakage, etc.

In primary cementing operations, the pipe string to be cemented is suspended in the well bore and both the pipe and well bore are usually filled with drilling fluid. In order to reduce contamination of the cement slurry at the interface between it and the drilling fluid, a cementing plug for sealingly engaging the inner surface of the pipe is pumped ahead of the cement slurry whereby the cement slurry is separated from the drilling fluid as it and the drilling fluid are displaced through the pipe. The cementing plug wipes the drilling fluid from the walls of the pipe ahead of the cement slurry and maintains a separation between the cement slurry and the drilling fluid until the plug seats in a cementing tool contained in the pipe string and positioned at the location where the cement slurry is to be introduced into the annulus.

The cementing plug which precedes the cement slurry and separates it from the drilling fluid is referred to herein as the first cementing plug. When the required quantity of the cement slurry has been pumped into the casing string, another cementing plug, referred to herein as the second cementing plug, is released into the casing string to separate the cement slurry from additional drilling fluid or other fluid used to displace the cement slurry down the pipe and into the annulus.

In cementing liners in applications like those mentioned above, the cementing tools utilized have often not included provision for the use of cementing plugs, and it has often not been possible to place the cement slurry in the annulus to be cemented adjacent to an inflatable packer without leaving a considerable amount of excess cement below the packer. Further, in using prior cementing tools it has often been difficult to inflate the packer without using a work string conveyed operating tool.

Thus, there is a need for improved well cementing inflation packer tools and methods of using the tools in cementing operations, particularly in the cementing of liners.

SUMMARY OF THE INVENTION

The present invention provides improved well cementing inflation packer tools and methods. The tools of the invention are basically comprised of a tubular housing adapted to be connected in a string of pipe to be cemented in a well bore which includes a packer inflating port disposed in a wall thereof. An internal opening sleeve is slidably disposed within the housing which is movable between a first position whereby the packer inflating port is closed and a second position whereby the port is open. The opening sleeve is adapted to receive a first cementing plug in sealing and locking engagement therewith. An external packer sleeve having a pressurized fluid inflatable packer element attached thereto is sealingly disposed over the outer surface of the housing and over the packer inflating port therein. The packer sleeve has an internal diameter greater than the external diameter of the outer surface of the housing thereby providing a passageway between the housing and the packer sleeve from the packer inflating port to the inflatable packer element. The packer sleeve also includes a cementing port disposed in a wall thereof between the packer element attached thereto and the packer inflating port in the housing. A check valve is disposed in the passageway between the packer element and the cementing port for allowing a packer inflating fluid, e.g., a cement slurry, to flow from the port to the packer element while preventing reverse flow therebetween. A fluid pressure rupturable member having a predetermined rupture pressure is sealingly attached to the packer sleeve over the cementing port therein.

It is, therefore, a general object of the present invention to provide improved well cementing inflation packer tools and methods of using the tools.

Other and further objects, features and advantages of the present invention will be readily apparent to those skilled in the art upon a reading of the description of preferred embodiments which follows when taken in conjunction with the accompanying drawings.

DETAILED DESCRIPTION OF THE PREFERRED EMBODIMENTS

Figure 1:
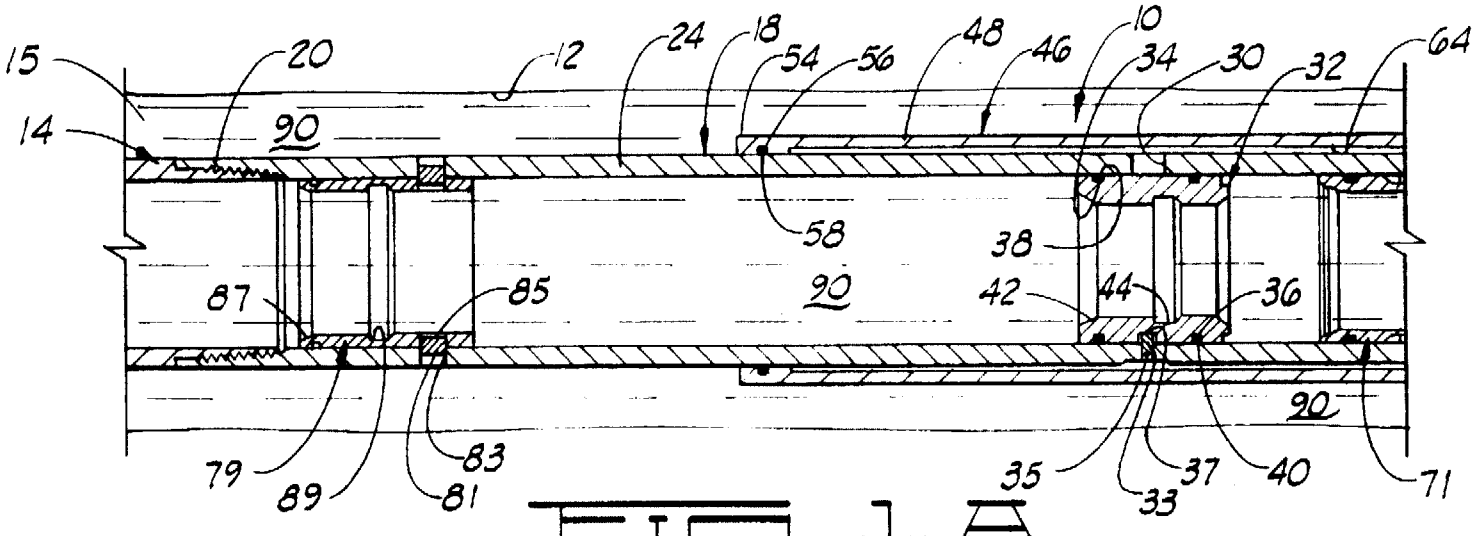
FIGS. 1A–1B show a longitudinal cross-sectional view of an improved cementing tool of this invention disposed in a horizontal well bore.
Figure 1:
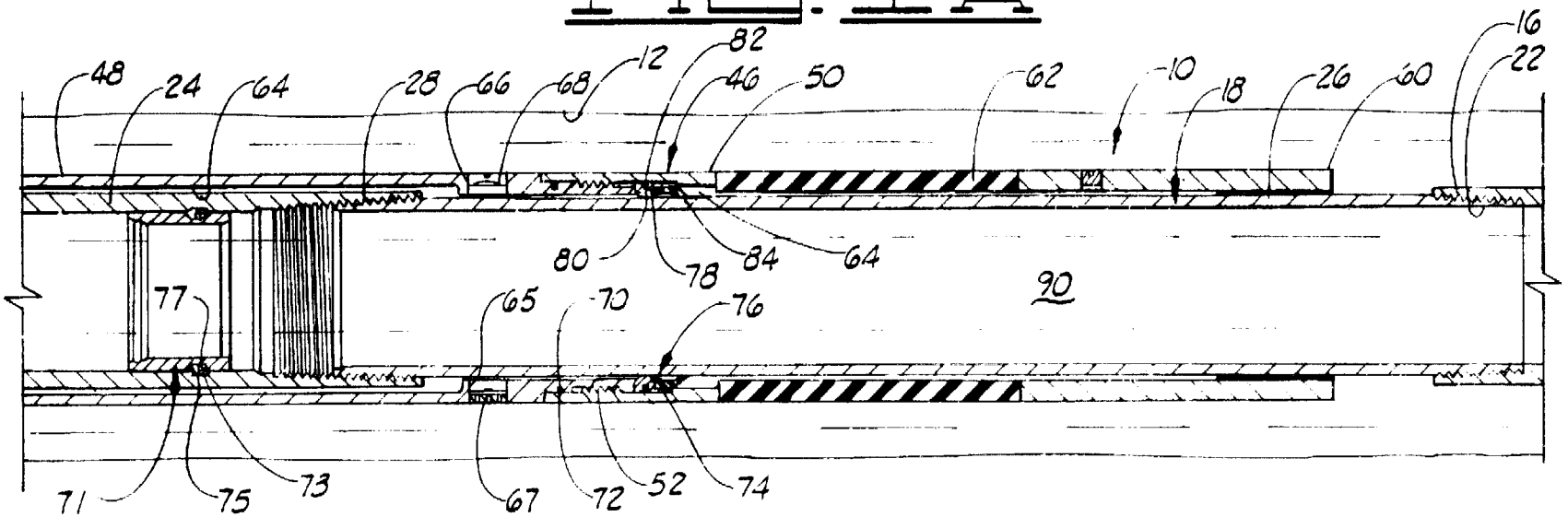

Referring now to the drawings, and particularly to FIGS. 1A–1B, an improved cementing tool of this invention is illustrated and generally designated by the numeral 10. The tool 10 is illustrated disposed in a well bore 12 and connected to a liner or other pipe string 14. In a typical deviated well completion, the pipe string 14 is a fluid tight section of a liner and one end of the tool 10 is connected thereto. The other end of the tool 10 (FIG. 1B) is connected to a slotted liner section 16 which extends into a productive portion of the well bore 12. As will be described hereinbelow, the liner 14 and a portion of the tool 10 are cemented in the well bore 12 using the tool 10 and the methods of this invention. The cementing operation is carried out so that a portion of the tool 10 adjacent the slotted liner 16 as well as the slotted liner 16 are not cemented and the productive portion of the well bore 12 is left open hole with the slotted liner 16 extending therein.

The tool 10 is comprised of an elongate tubular housing 18 having a first threaded end 20 connected to a complimentary threaded end of the fluid tight liner 14 and a second threaded end 22 connected to a complimentary threaded end of the slotted liner 16. The housing 18 is conveniently formed of two tubular parts 24 and 26 which are connected together at a threaded joint 28 (FIG. 1B). At least one packer inflating port 30 is disposed in a wall of the part 24 of the housing 18.

Figure 3:
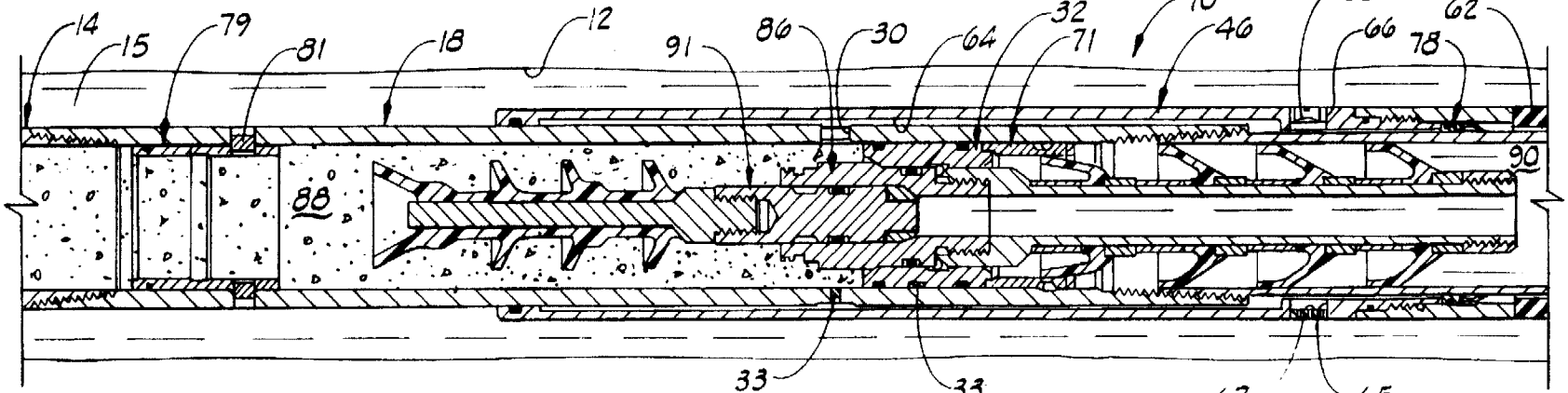
FIG. 3 is a cross-sectional view similar to FIG. 2, but showing the cementing tool and first cementing plug after a packer inflating port in the tool has been opened.

An internal opening sleeve 32 is slidably disposed within the part 24 of the housing 18 which is movable between a first position whereby the packer inflating port 30 is closed (FIG. 1A) and a second position whereby the packer inflating port 30 is open (see FIG. 3). The opening sleeve 32 includes a pair of grooves 34 and 36 which contain O-rings 38 and 40, respectively, for providing seals between inside surfaces of the housing 18 and the opening sleeve 32. As shown in FIG. 1A, when the opening sleeve 32 is in the closed position, the seal rings 38 and 40 are positioned on opposite sides of the packer inflating port 30 thereby preventing fluid leakage through the port 30. The opening sleeve 32 is adapted to receive a first cementing plug in sealing and locking engagement therewith. That is, the opening sleeve 32 includes an annular tapered seating surface 42 and an internal annular groove 44 for receiving a complimentary seating surface and a lock ring, respectively, on and a part of the first cementing plug. The opening sleeve 32 is held in its closed position by at least one shear pin 33 which is engaged in a bore 35 in the housing 18 and extends into a recess 37 in the sleeve 32.

An external packer sleeve 46, which for convenience is comprised of two parts 48 and 50 connected together at a threaded joint 52, is sealingly disposed over an outer surface of the housing 18. The part 48 of the packer sleeve 46 includes an annular groove 70 containing a seal ring 72 positioned adjacent the part 50 of the packer sleeve 46 which provides a seal therebetween. A first end 54 of the packer sleeve 46 is slidably disposed on the housing 18 and includes an internal annular groove 56 formed therein containing a seal ring 58 which provides a sliding seal between the packer sleeve 48 and the housing 18. The other end 60 of the packer sleeve 48 is sealingly attached to the housing 18 such as by welding, a glue joint or the like. A pressurized fluid inflatable packer element 62 is attached to the part 50 of the packer sleeve 46. As will be understood by those skilled in the art, when the packer element 62 is inflated, a portion of the packer sleeve 46 is moved whereby the end 54 thereof including the groove 56 and seal ring 58 slides towards the inflatable packer 62.

The packer sleeve 46 has an internal diameter which is greater than the external diameter of the housing thereby providing a passageway 64 between the housing 18 and the packer sleeve 46 from the packer inflating port 30 to the inflatable packer element 62.

The part 48 of the packer sleeve 46 includes at least one cementing port 66 disposed in a wall thereof positioned between the packer element 62 and the packer inflating port 30 in the housing 18. A fluid pressure rupturable member 68 having a predetermined rupture pressure is sealingly attached to the packer sleeve 46 across the cementing port 66 therein. Preferably, the part 48 includes two or more cementing ports 66 having rupturable members 68 attached thereto. The part 48 also includes at least one port 65 disposed in a wall thereof containing a conventional spring loaded pressure equalizing valve 67 for equalizing the pressure between the inside and outside surfaces of the fluid pressure rupturable member 68 attached to the packer sleeve 46. Like the rupturable member 68, two or more pressure equalizing valves 67 are preferably included in the tool 10.

Disposed within a counterbore 74 in the part 50 of the packer sleeve 46 and held therein by the part 48 is a check valve generally designated by the numeral 76. The check valve 76 functions to allow a packer inflating fluid, e.g., pressurized cement slurry, to flow from the packer inflating port 30 to the inflatable packer element 62 whereby the packer element 62 is inflated while preventing the reverse flow therebetween. The check valve 74 is comprised of an annular sleeve 78 which includes a groove 80 containing an O-ring 82 for providing a seal between the sleeve 78 and the internal surface of the part 50 of the packer sleeve 46. Attached within an internal recess in the sleeve 78 is an annular valve member 84 formed of resilient material. The end of the resilient valve member 84 adjacent the packer element 62 fits snugly against the outer surface of the housing 18. When a pressurized fluid flows through the packer inflating port 30 in the housing 18 and through the passageway 64, a force is exerted on the resilient valve member 84 which expands it away from the housing 18 whereby fluid flow is permitted. When the pressurized fluid tries to reverse flow through the passage 64 the resilient valve member 84 is forced against the housing 18 thereby preventing such reverse flow.

An opening sleeve retaining member 71 (best shown in FIG. 1B) is fixedly attached within the interior of the housing 18 for retaining the opening sleeve 32 after it is moved to its second open position. The retaining member 71 is held within the housing 18 by a lock ring 73 disposed in an annular groove 75 in the member 71 and in a corresponding recess 77 in the part 24 of the housing 18.

An internal cementing plug receiving sleeve 79 is also fixedly attached within the housing 18 by at least one pin 81 (two are shown) engaged in an opening 83 in the housing 18 and extending into a recess 85 in the sleeve 79. The cementing plug receiving sleeve 79 is adapted to receive a second cementing plug in sealing and locking engagement therewith. That is, the sleeve 81 includes an annular tapered seating surface 87 and a lock ring receiving recess 89.

Operation of the Tool 10

In accordance with the methods of this invention, the tool 10 is operated in a manner whereby a cement slurry is introduced into the annulus 15 between the walls of the well bore 12 and the liner 14 including the portion of the tool 10 between the liner 14 and the packer element 62 thereof after the packer element 62 has been inflated and sealed against the walls of the well bore 12. The inflated packer element 62 of the tool 10 prevents the cement slurry from flowing into the open hole section of the well bore 12 containing the slotted liner 16 during the cementing operation.

Figure 2:
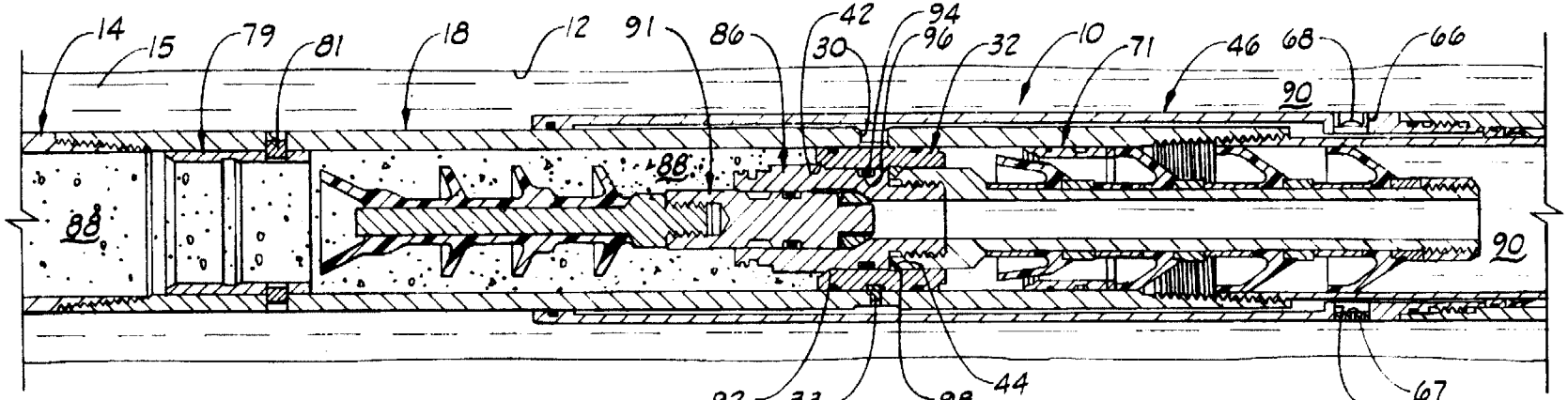
FIG. 2 is a cross-sectional view similar to FIG. 1A showing a portion of the cementing tool after a first cementing plug has landed in the tool.

The cementing tool 10 is connected to the liner 14 and the slotted liner 16 is attached to the end of the tool 10 opposite from the liner 14. The liner 14, the tool 10 and the slotted liner 16 are inserted in the well bore 12 and the tool 10 and slotted liner 16 are positioned within a deviated or horizontal portion of the well bore 12 which penetrates a productive zone or formation. Once the liner 14, the tool 10 and the slotted liner 16 are positioned properly within the well bore 12, the tool 10 is operated by displacing a first cementing plug 86 with a pressurized cement slurry 88 through the liner 14 and through the tool 10 into sealing and locking engagement with the internal opening sleeve 32 as shown in FIG. 2. The first cementing plug 86 is a typical subsurface release plug which is caused to be released from a conventional liner hanger and running tool (not shown) by a cementing plug releasing dart 91 in combination with fluid pressure which seats and locks within the cementing plug 86 as is also shown in FIG. 2.

Figure 4A:
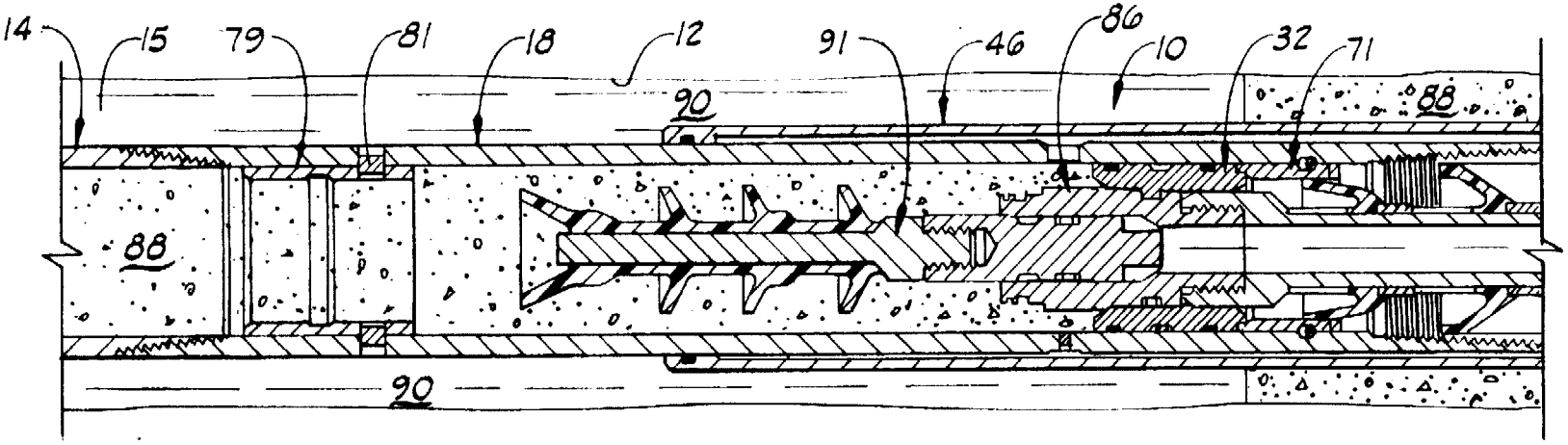
FIGS. 4A–4B show a cross-sectional view of the cementing tool after the inflatable packer element of the tool has been inflated.
Figure 4B:
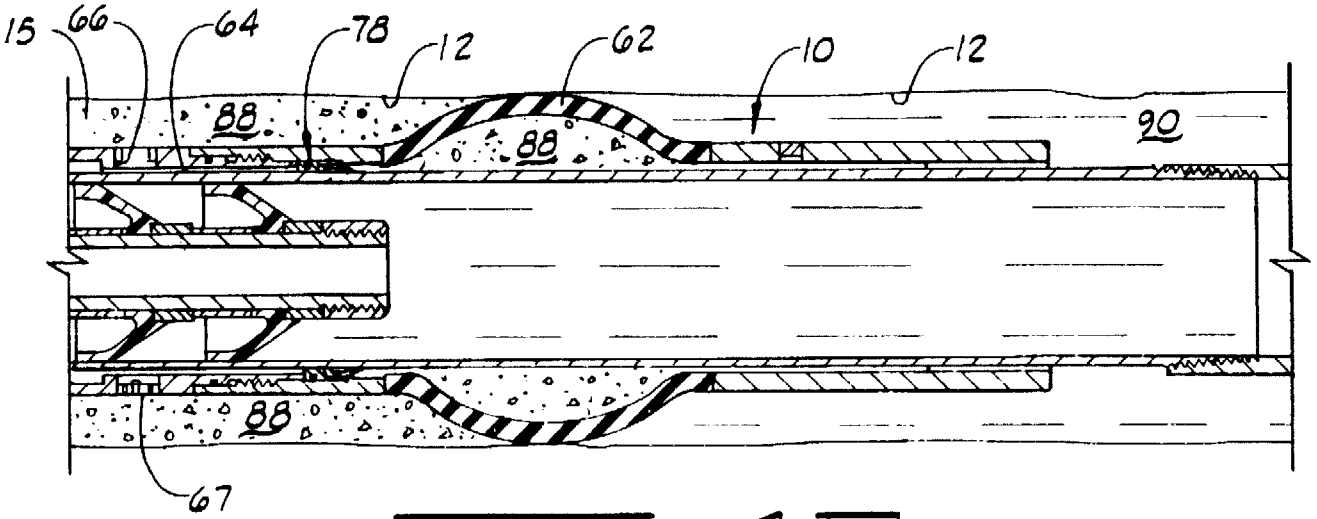

The cementing plug 86 includes a seating surface 92 which engages the annular tapered seating surface 42 of the opening sleeve 32, a seal ring 94 disposed in a groove 96 which provides a seal between the first cementing plug 86 and the opening sleeve 32 and a lock ring 98 which locks in the recess 44 of the sleeve 32. After the first cementing plug 86 has landed on and sealingly locked in the opening sleeve 32, the pressure level of the pressurized cement 88 is raised to shear the shear pin 33 and move the opening sleeve 32 to its second open position as shown in FIG. 3 whereby the packer inflating port 30 is opened. Upon the opening of the packer inflating port 30, the pressurized cement slurry 88 enters the passageway 64 and flows through it and through the check valve 78 to the inflatable packer element 62 whereby the inflatable packer element 62 is inflated as illustrated in FIGS. 4A–4B.

The pressure required to rupture the rupturable member 68 is higher than the pressure required to inflate the inflatable packer element 62. Thus, after the packer element 62 has been inflated with the pressurized cement slurry 88, the pressure level of the cement slurry 88 is continued to be increased until the rupturable member 68 ruptures and the cementing port 66 is opened as shown in FIG. 4B. When the cementing port 66 opens, the pressure of the pressurized cement slurry 88 is lowered as the pressurized cement slurry 88 flows through the port 66 into the annulus 15 between the liner 14 and the walls of the well bore 12. However, because of the presence of the check valve 78, the packer element 62 remains inflated.

Figure 5A:
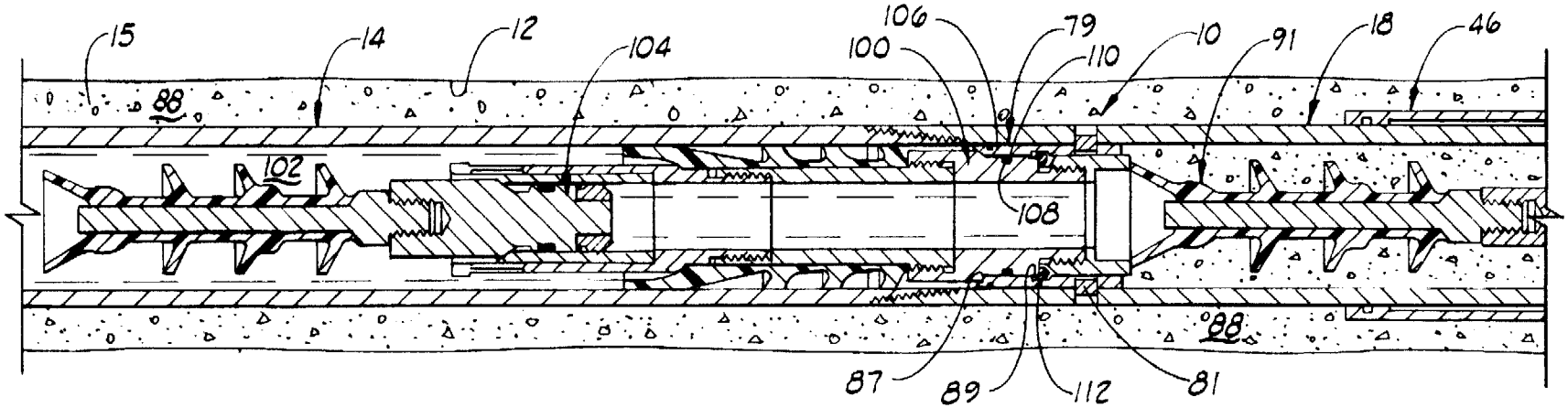
FIGS. 5A–5B show a cross-sectional view of the cementing tool after a second cementing plug has landed in the tool.
Figure 5B:
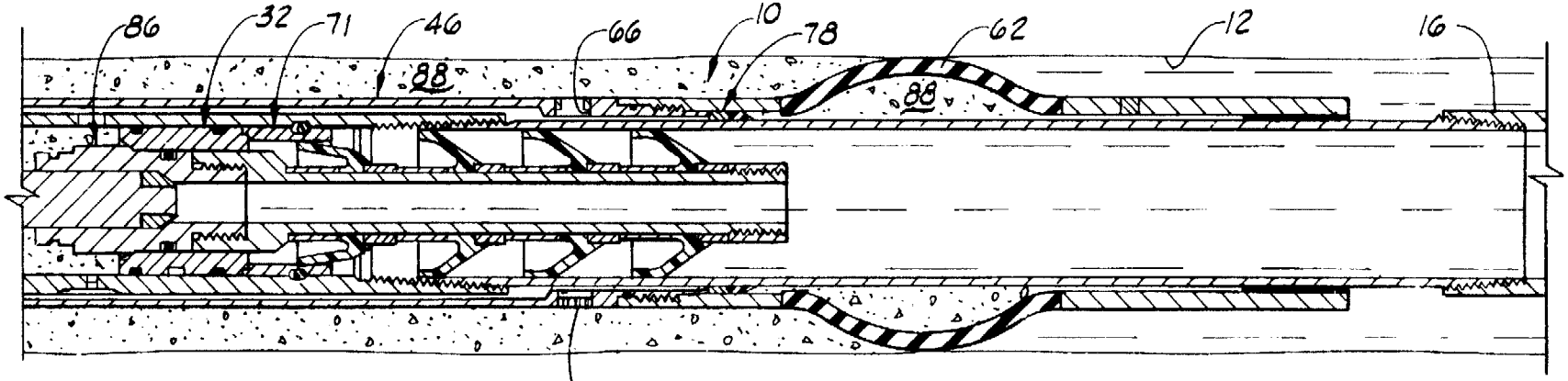

Referring now to FIGS. 5A–5B, after the required quantity of cement slurry 88 has been displaced into the annulus 15, the cement slurry can be allowed to set into a hard impermeable mass in the annulus whereby the liner 14 and a portion of the tool 10 are sealingly bonded to the walls of the well bore 12. However, in order to insure that the cement slurry displaced into the annulus 15 is not contaminated with the displacement fluid utilized, a second cementing plug 100 is preferably inserted into the liner 14 between the cement slurry 88 being displaced and the displacement fluid 102. The second cementing plug 100 includes a releasing dart 104 which is sealingly and lockingly engaged therewith. The second cementing plug 100 includes an annular tapered seating surface 106 which engages the annular tapered seating surface 87 of the cementing plug receiving sleeve 79, an annular groove 108 containing a seal ring 110 for providing a seal between the sleeve 79 and the cementing plug 100 and a locking ring 112 which engages the annular groove 89 of the sleeve 79 thereby locking the second cementing plug 100 in sealing engagement with the sleeve 79.

As mentioned, the second cementing plug 100 prevents contamination of the cement slurry 88 by wiping the walls of the liner 14 and maintaining a separation between the cement slurry 88 and the displacement fluid 102. Further, when the second cementing plug 100 locks and seals in the receiving sleeve 79 of the tool 10, backflow of the cement slurry 88 out of the annulus 15 and into the liner 14 is positively prevented. After the second cementing plug 100 has landed in the tool 10 in locking and sealing engagement therein, the cement slurry 88 in the annulus 15 is allowed to set whereby the liner 14 and a portion of the tool 10 are cemented in the well bore 12. As shown in FIGS. 5A–5B, the cement slurry 88 is not allowed to enter the open hole portion of the well bore 12 containing the slotted liner 16 by the inflated packer element 62.

After the cement slurry 88 has set in the annulus 15, the top cementing plug 100 and its releasing dart 104, the cementing plug receiving sleeve 81, the bottom cementing plug 86 and its releasing dart 91, the opening sleeve 32, and the retaining member 71 are drilled out of the housing 18 whereby produced fluids which flow into and through the slotted liner 16 can be produced to the surface by way of the housing 18 of the tool 10 and the liner 14.

Thus, the present invention is well adapted to carry out the objects and attain the benefits and advantages mentioned as well as those which are inherent therein. While numerous changes to the apparatus and methods can be made by those skilled in the art, such changes are encompassed within the spirit of this invention as defined by the appended claims.

What is claimed is:

1. An improved cementing tool which includes an inflatable formation packer for use in a well bore comprising:

(a) an elongate tubular housing adapted to be connected in a string of pipe to be cemented in said well bore, said tubular housing including a packer inflating port disposed in a wall thereof;

(b) an internal opening sleeve slidably disposed within said housing and movable between a first position whereby said packer inflating port is closed and a second position whereby said packer inflating port is open, said opening sleeve being adapted to receive a first cementing plug in sealing and locking engagement therewith;

(c) an external packer sleeve having a pressurized fluid inflatable packer element attached thereto sealingly disposed over the outer surface of said housing and said packer inflating port therein, said packer sleeve having an internal diameter greater than the external diameter of said housing thereby providing a passageway between said housing and said packer sleeve from said packer inflating port to said inflatable packer element, and said packer sleeve including a cementing port disposed in a wall thereof between said packer element attached thereto and said packer inflating port in said housing;

(d) check valve means disposed in said passageway between said packer element and said cementing port for allowing a packer inflating fluid to flow from said packer inflating port to said packer element while preventing reverse flow therebetween; and (e) a fluid pressure rupturable member having a predetermined rupture pressure sealingly attached to said packer sleeve over said cementing port therein.

2. The cementing tool of claim 1 which further comprises an internal opening sleeve retaining member fixedly disposed within said housing for retaining said opening sleeve after said sleeve is moved to its second open position.

3. The cementing tool of claim 1 which further comprises an internal cementing plug receiving sleeve fixedly disposed within said housing adapted to receive a second cementing plug in sealing and locking engagement therewith.

4. The cementing tool of claim 1 wherein said predetermined rupture pressure of said fluid pressure rupturable member is higher than the fluid pressure required to inflate said packer.

5. The cementing tool of claim 1 wherein one end of said external packer sleeve is sealingly attached to said housing and a sliding seal means is disposed between said packer sleeve and said housing at the other end of said packer sleeve.

6. The cementing tool of claim 1 which further comprises pressure equalizing means attached to said packer sleeve for equalizing pressure between the inside and outside surfaces of said fluid pressure rupturable member attached to said packer sleeve.

7. The cementing tool of claim 1 wherein said packer sleeve includes two or more cementing ports therein each of which has a fluid pressure rupturable member sealingly attached thereover.

8. The cementing tool of claim 5 wherein said packer sleeve includes two or more pressure equalizing means attached thereto.

9. An improved cementing tool which includes a pressurized cement inflatable formation packer for use in a well bore comprising:

(a) an elongate tubular housing adapted to be threadedly connected between the end of a string of pipe forming a liner to be cemented in said well bore and a slotted liner to be placed in an open hole portion of said well bore, said tubular housing including at least one pressurized cement packer inflating port disposed in a wall thereof;

(b) an internal opening sleeve slidably disposed within said housing and movable between a first position whereby said packer inflating port is closed and a second position whereby said packer inflating port is open, said opening sleeve being adapted to receive a first cementing plug in sealing and locking engagement therewith;

(c) an internal sleeve fixedly disposed within said housing adapted to receive a second cementing plug in sealing and locking engagement therewith;

(d) an internal opening sleeve retaining member fixedly disposed within said housing for retaining said opening sleeve after said opening sleeve is moved to its second open position;

(e) an external packer sleeve having a pressurized cement inflatable packer element attached thereto sealingly disposed over the outer surface of said housing and over said packer inflating port therein, said packer sleeve having one end sealingly attached to said housing and a sliding seal means disposed between said packer sleeve and said housing at the other end and having an internal diameter greater than the external diameter of said outer surface of said housing thereby providing a passageway between said housing and said packer sleeve from said packer inflating port to said inflatable packer element, and said packer sleeve including at least one liner cementing port disposed in a wall thereof between said packer element attached thereto and said packer inflating port in said housing;

(f) check valve means disposed in said passageway between said packer element and said cementing port for allowing pressurized cement to flow from said packer inflating port to said packer element while preventing reverse flow therebetween;

(g) a rupturable member having a predetermined rupture pressure sealingly attached to said packer sleeve over said cementing port therein, said predetermined rupture pressure of said rupturable member being higher than the pressure required to inflate said packer; and (h) at least one pressure equalizing means attached to said packer sleeve for equalizing pressure between the inside and outside surfaces of said rupturable member attached to said packer sleeve.

10. The cementing tool of claim 9 wherein said opening sleeve is held in said first closed position by at least one shearable member which shears at a predetermined pressurized cement differential pressure exerted thereon.

11. A method of cementing a string of pipe joints in a well bore comprising the steps of:

(a) connecting a cementing tool to said string of pipe, said cementing tool comprising an elongate tubular housing having a packer inflating port disposed in a wall thereof, an internal packer inflating port opening sleeve slidably disposed within said housing which is movable between a closed position and an open position and adapted to receive a first cementing plug in sealing and locking engagement therewith, an external packer sleeve having a pressurized fluid inflatable packer element attached thereto and a cementing port therein sealingly disposed over the outer surface of said housing and over said packer inflating port and providing a passageway from said packer inflating port to said inflatable packer element, check valve means disposed in said passageway between said packer element and said cementing port, and a fluid rupturable member having a predetermined rupture pressure sealingly attached over said cementing port;

(b) inserting said tool and said string of pipe into said well bore;

(c) displacing a first cementing plug with pressurized cement through said string of pipe into sealing and locking engagement with said internal opening sleeve of said cementing tool and moving said opening sleeve to its second position whereby said packer inflating port is opened;

(d) increasing the pressure level of said pressurized cement to thereby inflate said inflatable packer element by way of said packer inflating port with pressurized cement and to cause said rupturable member to rupture and open said cementing port in said tool;

(e) displacing additional cement through said string of pipe and through said cementing port in said tool into the annulus between said string of pipe and the walls of said well bore; and (f) allowing said cement to set into a hard impermeable mass in said annulus.

12. The method of claim 11 which further comprises the step of drilling cement, said first cementing plug and said opening sleeve out of said housing of said tool.

13. The method of claim 12 wherein said tool has a slotted liner connected to the end thereof opposite the end connected to said string of pipe, said slotted liner extending into an open hole portion of said well bore.

14. The method of claim 11 wherein said tool further comprises an internal cementing plug receiving sleeve fixedly disposed within said housing adapted to receive a second cementing plug in sealing and locking engagement therewith.

15. The method of claim 14 which further comprises the step of displacing a second cementing plug behind said additional cement through said string of pipe into sealing and locking engagement with said internal cementing plug receiving sleeve.

16. The method of claim 15 which further comprises the step of drilling said second cementing plug, said internal cementing plug receiving sleeve, cement, said first cementing plug and said opening sleeve out of said housing of said tool.

17. The method of claim 16 wherein said tool has a slotted liner connected to the end thereof opposite the end connected to said string of pipe, said slotted liner extending into an open hole portion of said well bore.

18. The method of claim 11 wherein said predetermined rupture pressure of said fluid pressure rupturable member is higher than the fluid pressure required to inflate said packer.

19. The method of claim 11 which further comprises pressure equalizing means attached to said packer sleeve for equalizing pressure between the inside and outside surfaces of said fluid pressure rupturable member attached to said packer sleeve.

20. The method of claim 11 wherein said opening sleeve is held in said first closed position by at least one shearable member which shears at a predetermined pressurized cement differential pressure exerted thereon.

* * * * *